US009226642B1

(12) United States Patent
Becknell et al.

(10) Patent No.: US 9,226,642 B1
(45) Date of Patent: Jan. 5, 2016

(54) LOW TEMPERATURE WAREWASHER WITH TEMPERATURE DRAIN FEATURE

(71) Applicant: Meiko USA, Inc., LaVergne, TN (US)

(72) Inventors: Dwayne A. Becknell, Kingston Springs, TN (US); Mark A. Ferguson, Rockvale, TN (US)

(73) Assignee: Meiko USA, LaVergne, TN (US)

( * ) Notice: Subject to any disclaimer, the term of this patent is extended or adjusted under 35 U.S.C. 154(b) by 400 days.

(21) Appl. No.: 13/786,790

(22) Filed: Mar. 6, 2013

(51) Int. Cl.

| | |
|---|---|
| ***A47L 15/00*** | (2006.01) |
| ***A47L 15/14*** | (2006.01) |
| ***A47L 15/16*** | (2006.01) |
| ***A47L 15/18*** | (2006.01) |
| ***A47L 15/22*** | (2006.01) |

(52) U.S. Cl.
CPC ..... *A47L 15/0018* (2013.01); *A47L 15/14* (2013.01); *A47L 15/16* (2013.01); *A47L 15/18* (2013.01); *A47L 15/22* (2013.01)

(58) Field of Classification Search
CPC ..... B08B 9/20; B08B 3/02; A47L 15/46; A47L 15/14; A47L 15/16; A47L 15/18; A47L 15/22
USPC ..... 134/25.2, 25.4, 56 R, 57 D, 56 D, 95.1, 134/98.1, 103.1, 103.2
See application file for complete search history.

(56) References Cited

U.S. PATENT DOCUMENTS

| | | | | |
|---|---|---|---|---|
| 3,465,761 | A * | 9/1969 | Grunewald et al. | 134/58 D |
| 4,552,162 | A * | 11/1985 | Finger | 134/57 R |
| 4,776,359 | A * | 10/1988 | Federighi et al. | 134/111 |
| 5,038,807 | A | 8/1991 | Bailey et al. | |
| 5,137,041 | A | 8/1992 | Hall | |
| 5,609,174 | A | 3/1997 | Ferguson | |
| 5,732,724 | A | 3/1998 | Becknell | |
| 5,904,162 | A | 5/1999 | Ferguson et al. | |
| 6,012,567 | A | 1/2000 | Ferguson et al. | |
| 6,591,846 | B1 | 7/2003 | Ferguson et al. | |
| 2006/0130884 | A1 * | 6/2006 | Liao | 134/94.1 |
| 2012/0097256 | A1 * | 4/2012 | Lopaciuk | 137/2 |
| 2012/0145195 | A1 | 6/2012 | Buser et al. | |

FOREIGN PATENT DOCUMENTS

| | | | |
|---|---|---|---|
| JP | 6030877 | A | 2/1994 |
| JP | 10272085 | A | 10/1998 |

* cited by examiner

*Primary Examiner* — Saeed T Chaudhry
(74) *Attorney, Agent, or Firm* — Lucian Wayne Beavers; Patterson Intellectual Property Law, PC

(57) ABSTRACT

A dump and fill low temperature chemical sanitizing warewasher includes a wash and rinse tank and a temperature sensor associated with the tank and configured to sense a water temperature within the tank. A controller is connected to the temperature sensor to receive the water temperature sensor. The controller is configured to initiate a low temperature drain and refill cycle prior to starting a wash cycle, if the controller determines that the water temperature is below a set point.

17 Claims, 7 Drawing Sheets

LOW TEMPERATURE WAREWASHER WITH TEMPERATURE DRAIN FEATURE

BACKGROUND OF THE INVENTION

1. Field of the Invention

The present invention relates to warewashing machines and methods, and more particularly, but not by way of limitation, to low temperature chemical sanitizing type warewashing apparatus.

2. Description of the Prior Art

In a typical low temperature chemical sanitizing type warewasher, a wash and rinse tank is filled with hot water at approximately 140° F. A rack of dishes is inserted in the washer and then the washer door is closed which actuates the wash cycle. A wash and rinse pump turns on to circulate the wash water from the tank to spray devices to wash the dishes. During the wash cycle detergent is pumped into the wash and rinse tank. After the wash cycle a solenoid drain valve opens to drain the wash and rinse tank. Wash water and food soil is dumped into a drain pan where it passes through a screen to an accumulator. Then, a fill valve opens and flushes the wash and rinse tank while the drain valve is open. The drain valve closes and the wash and rinse tank fills to an appropriate level and the fill valve closes. Sanitizer such as sodium hypochlorite and rinse additive are pumped into the wash and rinse tank. The wash and rinse pump again turns on and the dishes are rinsed. The wash and rinse pump then turns off and the cycle is complete. The rinse water is retained in the wash and rinse tank for use in the next wash cycle. The process is repeated for each successive rack of dishes or other tableware.

The typical low temperature chemical sanitizing warewasher machine does not include a heater in the wash and rinse tank. Thus if the machine is idle for an extended period of time the wash tank temperature will fall. If the operator does not manually drain and refill the tank before using the machine after an idle period, the machine will wash with water that is cooler than normal for proper operation. The typical outcome of this is a poor wash result from the warewasher.

SUMMARY OF THE INVENTION

In one embodiment a warewashing apparatus includes a wash and rinse tank for storing wash and rinse water, the tank having a drain outlet. A water supply conduit communicates with the tank. A fill valve is communicated with the water supply conduit. The fill valve is movable between a water supply open position and a water supply closed position. A drain valve is communicated with the drain outlet. The drain valve is movable between a drain open position and a drain closed position. A temperature sensor is operably associated with the tank and configured to sense a water temperature within the tank. A set point input is configured so that an operator can adjust a set point temperature for a minimum tank water temperature for a wash cycle. A controller is operably associated with the drain valve, the fill valve, the temperature sensor and the set point input. The controller is configured to initiate a low temperature drain and refill cycle of the tank prior to starting a wash cycle if the tank water temperature is below the set point temperature.

In another embodiment a dump and fill low temperature chemical sanitizing warewashing apparatus includes a wash and rinse tank. A temperature sensor is associated with the wash and rinse tank and is configured to sense a water temperature of water in the wash and rinse tank. A controller is connected to the temperature sensor to receive a water temperature signal. The controller is configured to initiate a low temperature drain and refill cycle prior to starting a wash cycle, if the controller determines that the water temperature is below a set point.

In another embodiment a method of operating an automatic warewashing machine comprises steps of:

(a) filling an unheated wash and rinse tank with pre-heated water;

(b) performing a wash cycle and a rinse cycle and retaining rinse water in the wash and rinse tank for use in a next wash cycle;

(c) activating the machine to activate the next wash cycle; and (d) before starting the next wash cycle, automatically determining whether a tank water temperature in the wash and rinse tank is below a set point temperature, and if the tank water temperature is below the set point temperature automatically draining and then refilling the tank prior to starting the next wash cycle.

In any of the above embodiments, the wash and rinse tank may be an unheated tank which does not include a tank heater for heating the water.

In any of the above embodiments, the temperature sensor may be located on an external wall of the tank such that the sensor does not contact water in the tank.

In any of the above embodiments, the drain valve may include a solenoid actuator configured to move the drain valve upon receipt of signals from the controller.

In any of the above embodiments, the fill valve may include a solenoid actuator configured to move the fill valve upon receipt of signals from the controller.

In any of the above embodiments, the controller may include a low temperature drain feature selector configured such that an operator can selectively enable or disable the low temperature drain and refill cycle.

In any of the above embodiments, the controller may be configured to receive a tank temperature signal from the temperature sensor, to receive a start wash signal, and then prior to starting the wash cycle, to determine whether the tank temperature is below the set point temperature. If the tank temperature is below the set point temperature the controller may initiate the drain and refill cycle.

In any of the above embodiments, the controller may include a user interface configured such that an operator may adjust the set point.

In any of the above embodiments, the controller may be configured such that only one low temperature drain and refill cycle will be performed upon receipt of a start wash signal, such that if the incoming water supply is not at a sufficiently high temperature, the machine will not repeatedly perform the drain and refill cycle.

Numerous objects, features and advantages of the present invention will be readily apparent to those skilled in the art upon a reading of the following disclosure when taken in conjunction with the accompanying drawings.

DETAILED DESCRIPTION

Figure 1:
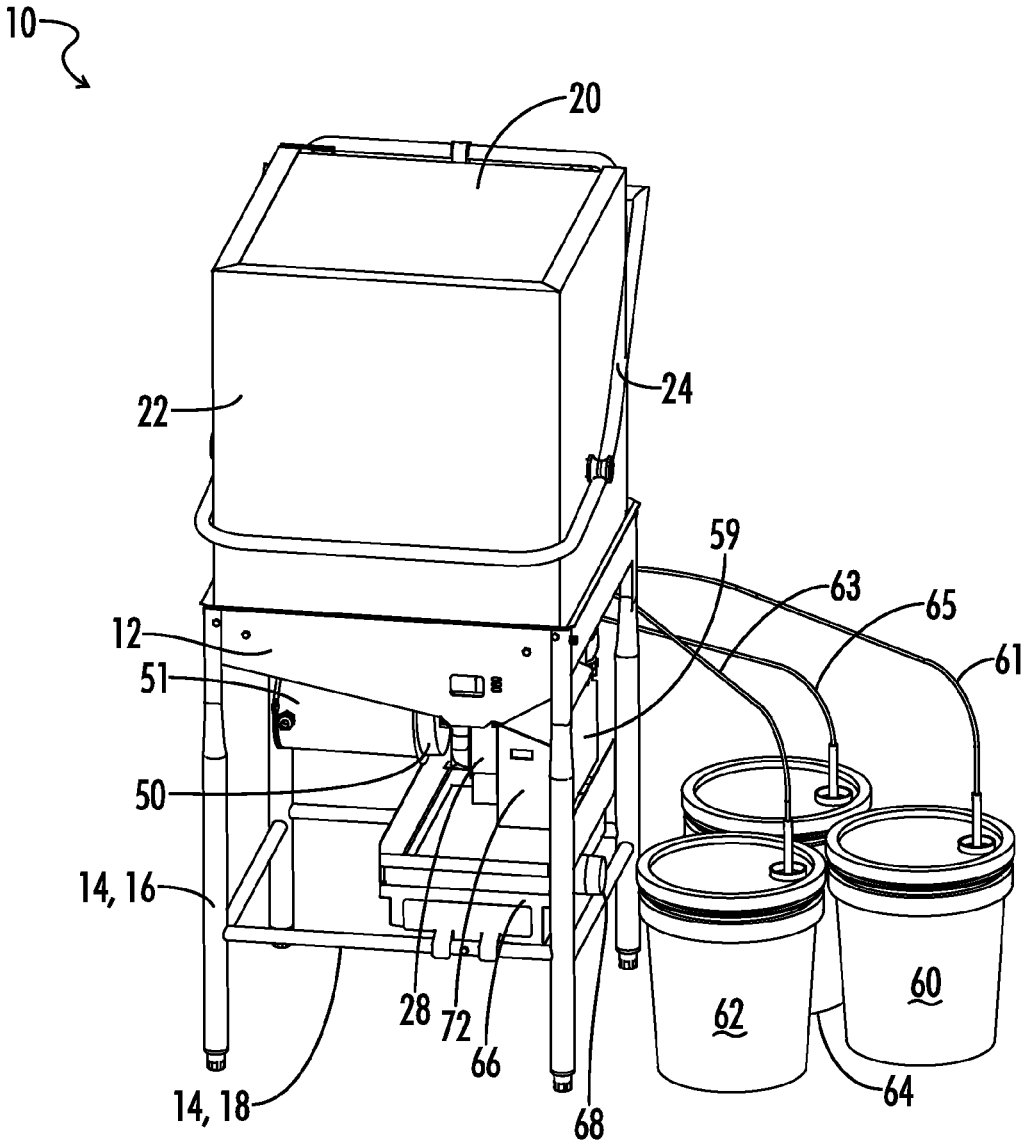
FIG. 1 is a perspective view of the warewashing machine of the present invention.

Referring now to the drawings, and particularly to FIG. 1, a washing machine apparatus is shown and generally designated by the numeral 10. The washing machine may be referred to as a dishwasher or more generally a warewasher, for washing dishes or other tableware. The washing machine 10 includes a wash and rinse tank 12 for storing wash and rinse water. The tank 12 is supported by a tubular frame 14. The frame 14 is made up of four legs 16 and four cross braces 18.

Extending upward from the tank 12 is an upper housing 20, three sides of which are enclosed by a door 22 which can be raised by lifting a handle 24.

Figure 2:
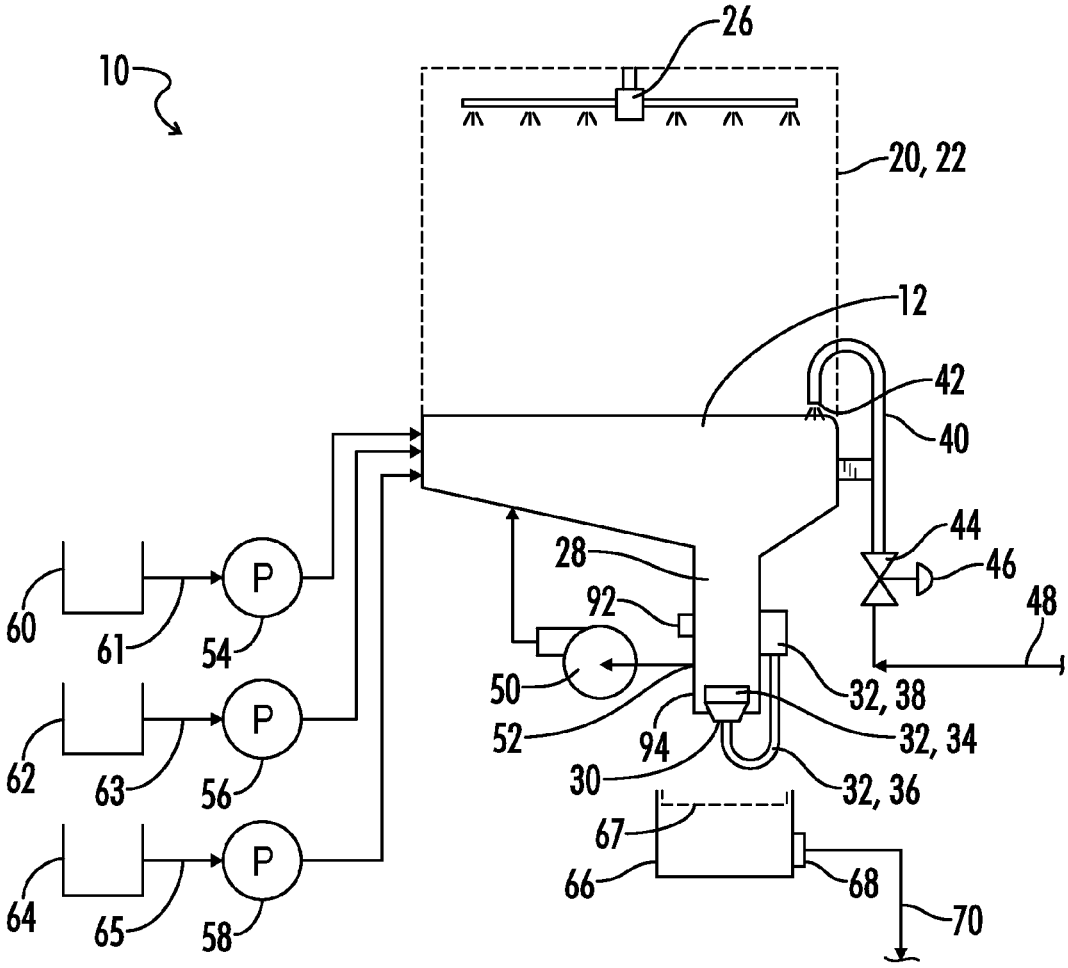
FIG. 2 is a schematic illustration showing the mechanical fluid flow components of the washing machine of FIG. 1.

As schematically seen in FIG. 2, within the upper housing 20 are spray apparatus such as that schematically indicated as 26 for spraying wash and rinse water on dishes contained within the upper housing.

As is best seen in FIG. 2, the tank 12 includes a sump 28. A drain outlet 30 is defined in the lower end of the sump 28. A drain valve 32 includes a movable stopper 34 which is shown in FIG. 2 in a closed position closing the drain outlet 30. The stopper 34 is connected to a U-shaped actuator rod 36 which is operably engaged with a drain valve solenoid 38. Upon actuation of the solenoid 38 the U-shaped actuating rod 36 is raised thus lifting the stopper 34 to an open position to allow water to drain from the tank 12 through the outlet 30.

A water supply conduit 40 is communicated with the tank 12 such as at conduit outlet 42 schematically illustrated in FIG. 2. A solenoid actuated fill valve 44 is communicated with the water supply conduit 40 and is movable between a water supply open position and a water supply closed position upon actuation of a solenoid actuator 46.

The water supply conduit 40 is communicated with a hot water supply line 48 which provides hot water from a conventional hot water tank (not shown) within the building in which the warewasher 10 is being used. The hot water supply line 48 will typically provide domestic hot water at a temperature of approximately 140° F. from the hot water supply tank.

A wash and rinse pump 50 is connected to the sump 28 at 52 and pumps water from the sump 28 back through the spray apparatus 26 to wash and to rinse dishes contained in the machine. The wash pump 50 may be a centrifugal pump driven by an electric wash motor 51. It will be appreciated that the spray apparatus 26 is shown only schematically and there will typically be both upper and lower spray bars or other spray nozzle arrangements which spray high pressure water from the pump 50 into the interior of the warewashing machine. The water from the spray apparatus 26 will fall back into the tank 12, so that the pump 50 circulates the water in a loop through the washing machine 10.

The machine 10 includes a detergent pump 54, a sanitizer pump 56, and a rinse additive pump 58, which may be located within a control box 59 shown in FIG. 1.

Detergent pump 54 draws liquid detergent from a detergent source 60 through detergent supply line 61. Sanitizer pump 56 draws liquid sanitizer from sanitizer source 62 through a sanitizer supply line 63. Rinse additive pump 58 draws liquid rinse additive from a rinse additive source 64 through a rinse additive supply line 65. As is best seen in FIG. 1, the detergent source 60, sanitizer source 62, and rinse additive source 64 may be separate containers placed on the floor adjacent to the washing machine 10.

When the drain valve 32 is open, water from the tank 12 dumps into a drain pan 66. The drain pan 66 has a screen 67 over its open upper end. Water which accumulates in drain pan 66 exits through drain pan outlet 68 from which it is conducted to a sewer line 70 or other disposal location.

A controller 72 is mounted within the control box 59. The details of the controller 72 and its interconnection with the mechanical components of washing machine 10 are best shown in the electrical schematic of FIG. 3.

The controller 72 further includes a processor 74, a computer-readable memory medium 76, a database 78 and an I/O platform or module which may include a user interface 80. The various components of the controller 72 may be mounted upon a control board 73 located within the control box 59.

The term "computer-readable memory medium" as used herein may refer to any non-transitory medium 76 alone or as one of a plurality of non-transitory memory media 76 within which is embodied a computer program product 82 that includes processor-executable software, instructions or program modules which upon execution may provide data or otherwise cause a computer system to implement subject matter or otherwise operate in a specific manner as further defined herein. It may further be understood that more than one type of memory media may be used in combination to conduct processor-executable software, instructions or program modules from a first memory medium upon which the software, instructions or program modules initially reside to a processor for execution.

"Memory media" as generally used herein may further include without limitation transmission media and/or storage media. "Storage media" may refer in an equivalent manner to volatile and non-volatile, removable and non-removable media, including at least dynamic memory, application specific integrated circuits (ASIC), chip memory devices, optical or magnetic disk memory devices, flash memory devices, or any other medium which may be used to store data in a processor-accessible manner, and may unless otherwise stated either reside on a single computing platform or be distributed across a plurality of such platforms. "Transmission media" may include any tangible media effective to permit processor-executable software, instructions or program modules residing on the media to be read and executed by a processor, including without limitation wire, cable, fiber-optic and wireless media such as is known in the art.

The term "processor" as used herein may refer to at least general-purpose or specific-purpose processing devices and/or logic as may be understood by one of skill in the art, including but not limited to single- or multithreading processors, central processors, parent processors, graphical processors, media processors, and the like.

Figure 3:
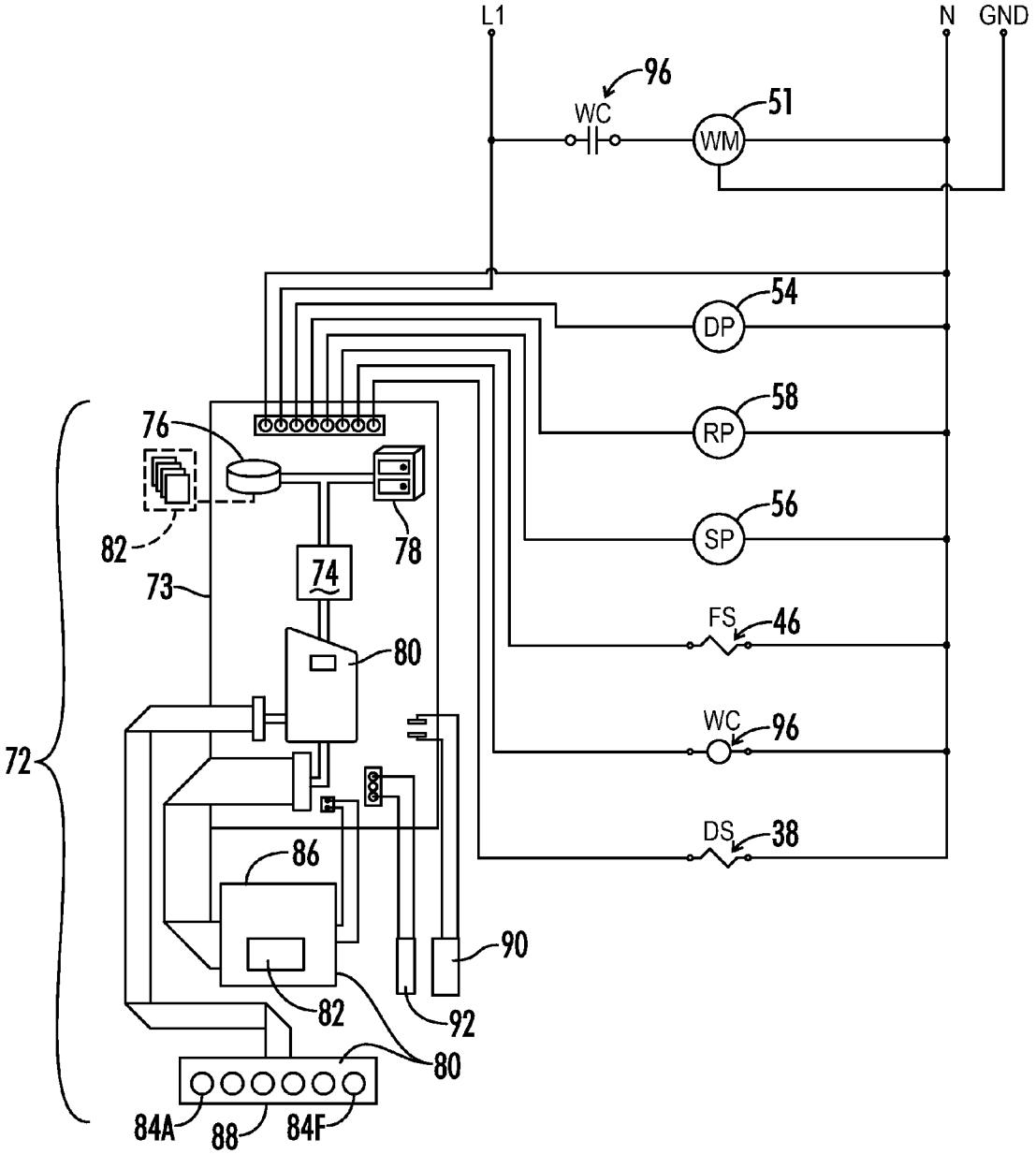
FIG. 3 is an electrical schematic of the controller and the various connections to the mechanical components of the washing machine of FIG. 1.
Figure 4:
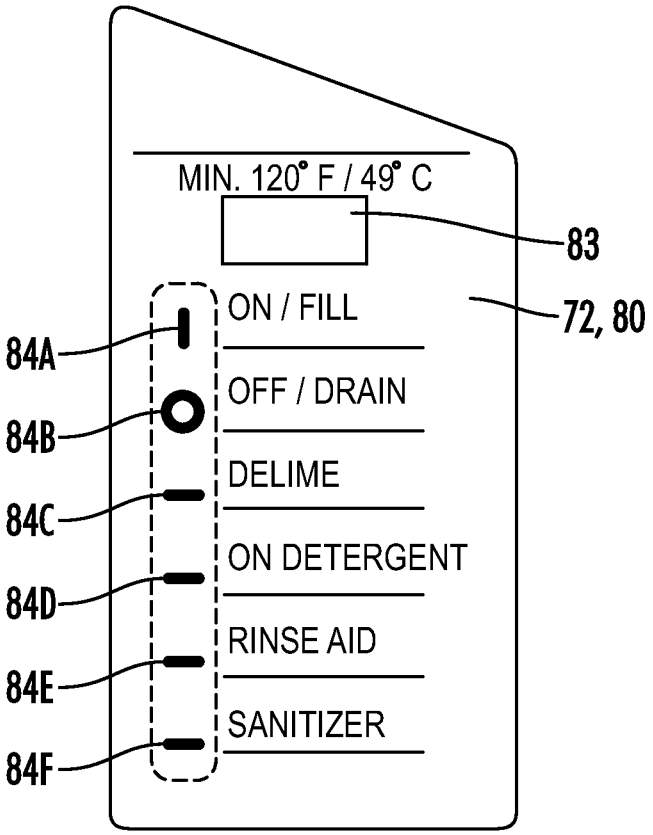
FIG. 4 is an elevation view of a user interface for the controller of FIG. 3.

FIG. 4 shows an elevation view of an embodiment of the user interface 80. The user interface 80 may include a display screen 83, and a plurality of input switches 84A, 84B, 84C, 84D, 84E and 84F. As schematically illustrated in FIG. 3, the display screen 83 may be mounted on a display board 86, and the input switches 84A-84F may be membrane switches mounted in a membrane switch strip 88.

As seen in FIG. 2, the washing machine 10 includes a temperature sensor 92 operably associated with the tank 12 and configured to sense a water temperature within the tank 12. The temperature sensor 92 may be located on an external wall 94 of the sump 28 of tank 12 and may sense the temperature of the water within the tank 12 without contacting the water. The sensor 92 may for example be a resistance temperature detector, such as the Model RP102T22 sensor available from Spectrum Sensors & Controls, Inc. of St. Marys, Pa.

A wash contactor switch 96 schematically shown in FIG. 3 is operably associated with the door 22 of washing machine 10 such that the wash contactor 96 will close when the door 22 is closed, thus providing a signal to the controller 92 to initiate the wash process. As is apparent in FIG. 3, the wash contactor switch 96 also permits power to flow to the wash motor 51 when the wash contactor switch 96 is closed.

The user interface 80 is best shown in FIG. 4. The user interface 80 provides a set point input which is configured such that an operator can adjust a set point temperature for a minimum water tank temperature for a wash cycle of the washing machine 10.

The user interface 80 also provides a low temperature drain feature selector configured such that the operator can selectively enable or disable the low temperature drain and refill cycle of the washing machine 10.

As is seen in FIG. 3, the controller 72 is operably communicated with the user interface 80 to receive inputs therefrom and to communicate information thereto to be displayed on display 83.

The controller 72 also receives inputs from the temperature sensor 90 and the wash contactor switch 96. The controller 92 also communicates with the wash motor 51, the detergent pump 54, the rinse additive pump 58, the sterilizer pump 56, the solenoid 46 of fill valve 44, and the solenoid 38 of drain valve 32 as schematically illustrated in FIG. 3.

The following is one example of the way in which the controller 72 may be programmed to utilize the user interface 80 to provide a set point input function and a low temperature drain feature disable/enable function.

Figure 5:
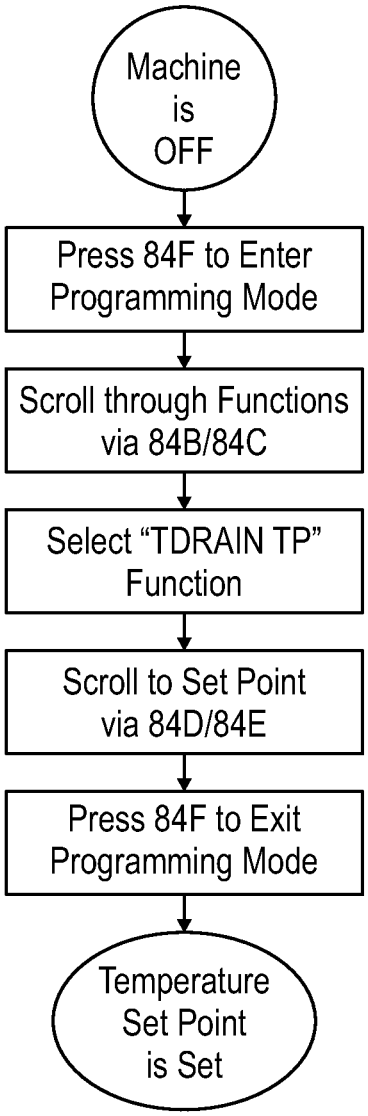
FIG. 5 is a flow chart illustrating the use of the user interface to set a low temperature set point for the water in the tank.

As schematically illustrated in the flow chart of FIG. 5 the primary steps of the set point input function of user interface 80 as follows:

(1) With the machine 10 off, switch 84F may be pressed to enter the programming mode.

(2) Then switches 84B and 84C may be used to scroll up or down to the various programmable functions which will be displayed on the display screen 83.

(3) Using the switches 84B and 84C to scroll through the functions displayed on display screen 83 the appropriate function corresponding to the setting of the temperature set point may be selected, which may for example be referred to as "T DRAIN TP".

(4) Once in the "T DRAIN TP" function, the switches 84D and 84E may be used to scroll through the available set point temperatures until the desired set point temperature is reached. For example, the available temperatures may be anything within a range of from about 100° F. to about 130° F., available in one degree increments.

(5) Upon reaching the desired temperature set point as displayed on display screen 83, the programming mode can be exited by pressing switch 84F, and the temperature set point is now set at the desired value.

Figure 6:
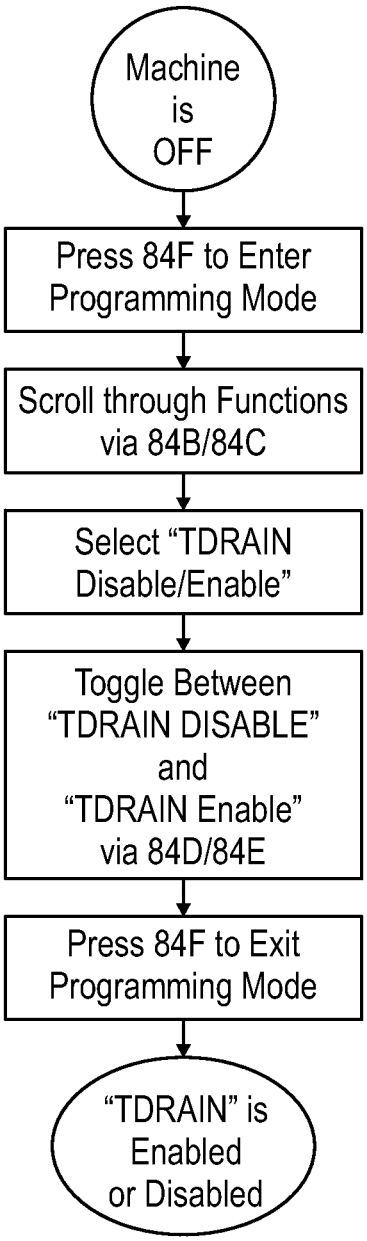
FIG. 6 is a flow chart illustrating the use of the user interface to enable or disable the low temperature drain and refill cycle.

Referring now to FIG. 6, a flow chart is provided illustrating the steps performed via the user interface 80 to selectively enable or disable the low temperature drain and refill cycle as follows:

(1) Assuming that the operation starts with the washing machine off, the switch 84F is pressed to enter programming mode.

(2) Then, once again using the switches 84B and 84C the operator may scroll through the available functions which are displayed on the display screen 83.

(3) The scrolling is stopped at the selected function corresponding to enabling and disabling the low temperature drain and refill cycle, which may for example be displayed as "T DRAIN DISABLE" or "T DRAIN ENABLE" depending on the current state of the setting.

(4) Then using switches 84D and 84E the operator may toggle between "T DRAIN DISABLE" and "T DRAIN ENABLE" as displayed on the display screen 83.

(5) With the function selector in the desired "T DRAIN DISABLE" or "T DRAIN ENABLE" position, the operator presses switch 84F to exit the programming mode.

(6) The washing machine 10 now has the "T DRAIN" function enabled or disabled as selected.

Alternatively to providing the temperature set point input feature and the low temperature drain enable/disable feature via the user interface 80 of a microprocessor controller, electromechanical control switches or knobs may be utilized for setting the set point and for enabling or disabling the low temperature drain and refill feature.

Figure 7:
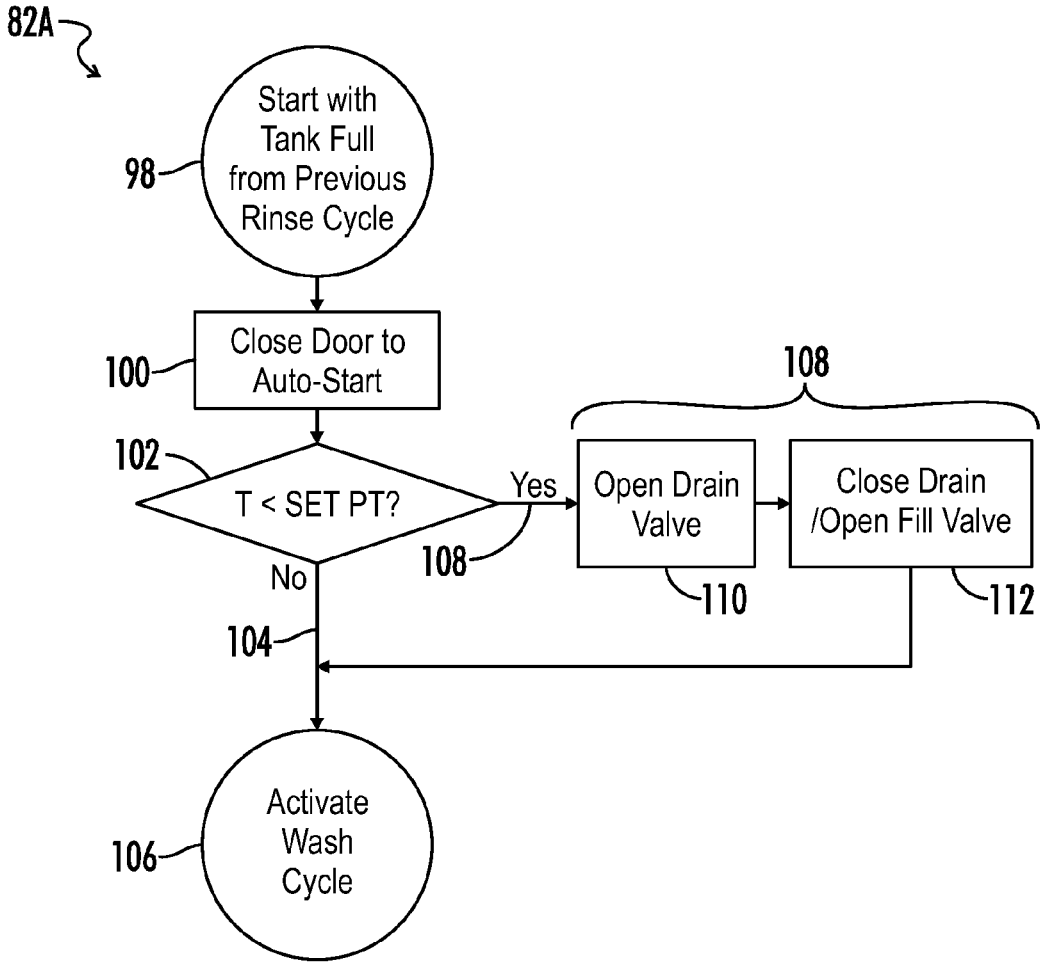
FIG. 7 is a schematic flow chart illustrating the logic utilized by the controller in performing the low temperature drain and refill cycle.

Referring now to FIG. 7, a schematic flow chart is there provided for a portion of the computer software programming 82 embodied in the controller 72. In FIG. 7 a software portion 82A which may also be referred to as a programming module 82A is illustrated which enables the controller 72 to perform the function of initiating a low temperature drain and refill cycle of the tank 12 prior to starting a wash cycle, if the tank water temperature is below the set point temperature.

As indicated at block 98 the typical starting condition for the washing machine 10 is that the wash and rinse tank 12 will be full from the previous rinse cycle. As previously noted, the rinse water from a rinse cycle is retained in the tank 12 and is typically used for the next wash cycle.

As indicated at block 100, upon closing the door 22 of washing machine 10 the wash contactor switch 96 is closed which typically functions as an auto start signal to the controller 72 to start the next wash cycle.

Prior to starting the wash cycle, the programming module 82A determines as indicated at block 102 whether the tank temperature "T" is less than the set point temperature which has previously been entered as was described above with regard to FIG. 5.

As indicated at branch 104, if the tank temperature is not less than the set point temperature, the programming module 82A then moves to block 106 which begins to activate the normal wash and rinse cycle which is further described below with regard to FIG. 8.

As indicated by branch 108, if the tank temperature as sensed by sensor 92 is less than the set point temperature, a drain and refill cycle 108 is performed. The drain and refill cycle 108 includes the first step of opening the drain valve 32 as indicated at block 110. The drain valve 32 may be opened by an appropriate command signal from controller 72 that directs power to the solenoid 38 to hold the drain valve open for an appropriate period of time.

Then, as indicated at block 112, the drain valve 32 is closed and the fill valve 44 is opened to refill the tank 12 with hot water from the hot water supply line 48. The fill valve 46 is opened by the sending of an appropriate signal from controller 72 to provide power to the fill valve solenoid 46 to hold the fill valve open for an appropriate period of time to fill tank 12 to the proper level.

After the tank 12 has been refilled, the fill valve again closes and the control logic moves on to the activate wash cycle block 106.

After the low temperature drain and refill cycle 108, the control logic moves on to block 106 to activate the wash cycle thus starting the next wash cycle regardless of whether the tank water temperature in the tank 12 is still below the set point temperature. Thus, for example, if there is a problem with the temperature of the incoming water from water supply line 48, the machine will not continue to dump and refill the tank 12 repeatedly due to the low temperature water coming into the tank 12. Preferably the controller 72 will only perform a single low temperature drain and refill cycle in response to sensing a water temperature below the set point at the beginning of a wash cycle.

Figure 8:
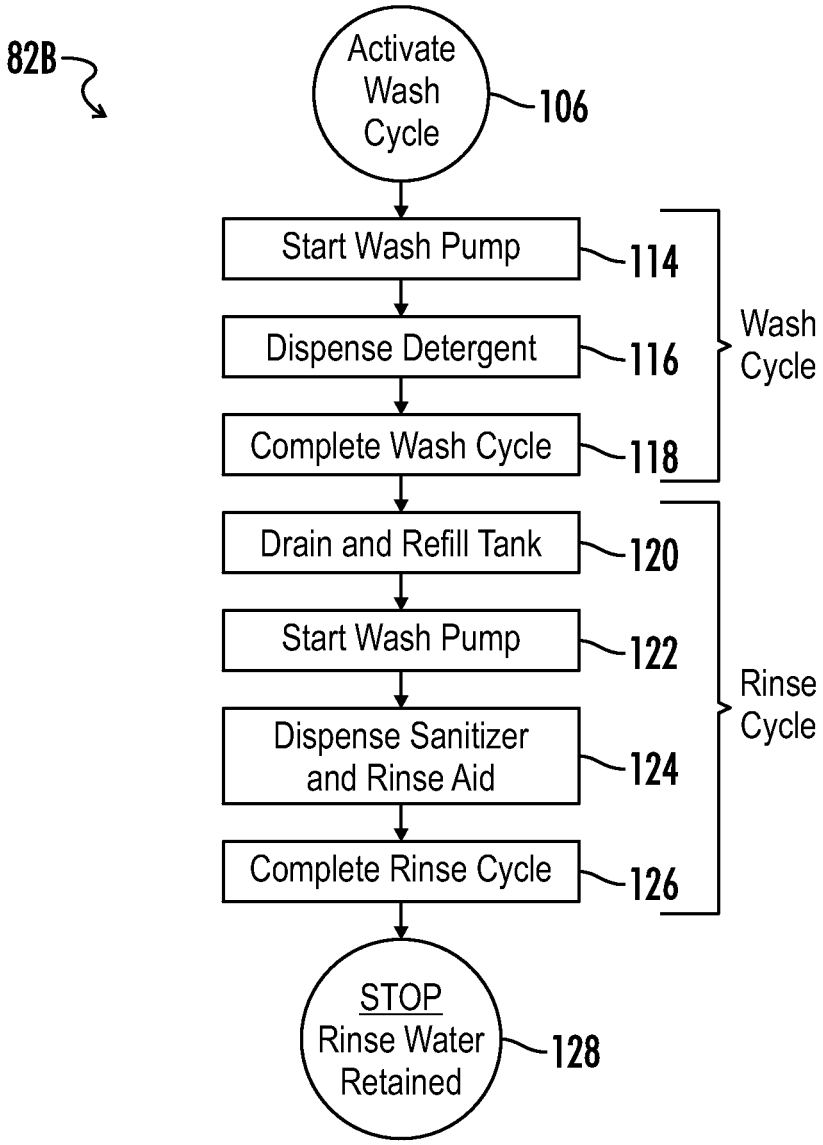
FIG. 8 is a schematic flow chart illustrating the logic performed by the controller when implementing a typical wash and rinse cycle.

Referring now to FIG. 8, a flow chart is there shown for the programming logic module 82B for a typical wash and rinse cycle.

Starting at the activate wash cycle block 106 carried forward from FIG. 7, the controller 72 initiates a wash cycle by starting the wash pump 50 as indicated at block 114, dispensing detergent into the tank 12 via the detergent pump 54 as indicated at block 116, and continuing to circulate wash water and detergent through the washing machine 10 with the wash pump 50 until the wash cycle is completed as indicated at block 118.

The rinse cycle then begins as indicated at block 120 by opening the drain valve 32 to drain wash water and food soil into the drain pan 66. As the wash water is draining, the fill valve 44 is turned on to flush the tank 12 with the drain valve 32 open. The drain valve 32 then closes and the fill valve 44 remains open to fill the tank 12 to the appropriate level with clean hot water from hot water supply line 48, and then the fill valve 44 closes.

Then as indicated at blocks 120 and 122 the wash pump 50 is turned on and sanitizer and rinse aid are pumped into the tank 12 via sanitizer pump 56 and rinse aid pump 58. The rinse cycle continues for an appropriate interval of time as indicated at 126, then the wash pump 50 turns off and the cycle is ended as indicated at block 128 with the rinse water being retained in the wash tank 12.

A typical total time for a wash and rinse cycle from block 106 through 128 may be 90 seconds with the wash cycle taking approximately 45 seconds, the drain and refill step 120 taking approximately 15 seconds, and the remainder of the rinse cycle taking approximately 30 seconds.

A method of operating the automatic warewashing machine 10, including the low temperature drain and refill cycle, can generally be described as including steps of:

(a) filling the unheated wash and rinse tank 12 with preheated water from the hot water supply line 48;

(b) performing a wash cycle and a rinse cycle generally as indicated in FIG. 8 and then retaining the rinse water in the wash and rinse tank 12 for use in the next wash cycle;

(c) activating the washing machine 10 by closing the door 22 and closing the wash contact switch 96 to activate the next wash cycle; and (d) as indicated in FIG. 7, before starting the next wash cycle, automatically determining whether the tank water temperature in the wash and rinse tank 12 is below the set point temperature, and if the tank water temperature is below the set point temperature automatically draining and then refilling the tank as indicated at blocks 110 and 112 prior to starting the next wash cycle.

Thus it is seen that the methods and apparatus of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A warewashing apparatus, comprising:

a common wash and rinse tank for storing wash water and rinse water, the tank having a drain outlet;

a water supply conduit communicated with the tank;

a fill valve communicated with the water supply conduit, the fill valve being movable between a water supply open position and a water supply closed position;

a drain valve communicated with the drain outlet, the drain valve being movable between a drain open position and a drain closed position;

a temperature sensor operably associated with the tank and configured to sense a water temperature within the tank;

a set point input configured so that an operator can adjust a set point temperature for a minimum tank water temperature for a wash cycle; and a controller operably associated with the drain valve, the fill valve, the temperature sensor and the set point input, the controller being configured to automatically control a wash cycle and then a rinse cycle in the common wash and rinse tank upon receiving a start wash cycle signal, the controller being configured to initiate a low temperature drain and refill cycle of the tank prior to starting the wash cycle if the tank water temperature is below the set point temperature.

2. The apparatus of claim 1, wherein:

the wash and rinse tank does not include a tank heater.

3. The apparatus of claim 1, wherein:

the temperature sensor is located on an external wall of the tank and does not contact water in the tank.

4. The apparatus of claim 1, wherein:

the drain valve includes a solenoid actuator configured to move the drain valve to the drain open position upon receipt of an open drain signal from the controller.

5. The apparatus of claim 1, wherein:

the fill valve includes a solenoid actuator configured to move the fill valve to the water supply open position.

6. The apparatus of claim 1, wherein:

the controller includes a low temperature drain feature selector configured such that an operator can selectively enable or disable the low temperature drain and refill cycle.

7. The apparatus of claim 1, wherein the controller is configured to:

receive a tank temperature signal from the temperature sensor;

receive the start wash cycle signal;

prior to starting the wash cycle, determine whether the tank temperature is below the set point temperature; and if the tank temperature is below the set point temperature, initiate the drain and refill cycle.

8. A dump and fill low temperature chemical sanitizing warewashing apparatus, comprising:

a common wash and rinse tank;

a temperature sensor associated with the wash and rinse tank and configured to sense a water temperature of water in the wash and rinse tank; and a controller connected to the temperature sensor to receive a water temperature signal, the controller being configured to automatically control a wash cycle and then a rinse cycle in the common wash and rinse tank upon receiving a start wash cycle signal, the controller being configured to initiate a low temperature drain and refill cycle prior to starting the wash cycle, if the controller determines that the water temperature is below a set point.

9. The apparatus of claim 8, wherein:

the controller includes a user interface configured such that an operator may adjust the set point.

10. The apparatus of claim 9, wherein:

the user interface includes a selector configured such that the operator may selectively enable or disable the low temperature drain and refill cycle.

11. The apparatus of claim 8, further comprising:

a solenoid operated drain valve communicated with the tank; and wherein the controller is operably associated with the solenoid operated drain valve.

12. The apparatus of claim 8, further comprising:

a solenoid operated fill valve communicated with the tank; and wherein the controller is operably associated with the solenoid operated fill valve.

13. The apparatus of claim 8, wherein:

the tank is unheated.

14. A method of operating an automatic warewashing machine, the method comprising:

(a) filling an unheated common wash and rinse tank with pre-heated water;

(b) performing a wash cycle and a rinse cycle and retaining rinse water in the wash and rinse tank for use in a next wash cycle;

(c) activating the machine to activate the next wash cycle; and (d) before starting the next wash cycle, automatically determining whether a tank water temperature in the wash and rinse tank is below a set point temperature, and if the tank water temperature is below the set point temperature automatically draining and then refilling the tank prior to starting the next wash cycle.

15. The method of claim 14, wherein:

step (d) comprises receiving a tank temperature signal in a controller and transmitting control signals from the controller to a drain valve and a fill valve.

16. The method of claim 15, further comprising:

adjusting the set point temperature via a user interface of the controller.

17. The method of claim 14, further comprising:

after step (d), starting the next wash cycle regardless of whether the tank water temperature of the refilled tank is still below the set point temperature.

* * * * *